US006692091B2

(12) United States Patent
Mulaw

(10) Patent No.: US 6,692,091 B2
(45) Date of Patent: Feb. 17, 2004

(54) MAIL AND RELATED DOCUMENTS/ITEMS ORGANIZER

(76) Inventor: Azanaw Mulaw, 1901 Thistlewood Dr., Fort Washington, MD (US) 20744

( * ) Notice: Subject to any disclaimer, the term of this patent is extended or adjusted under 35 U.S.C. 154(b) by 0 days.

(21) Appl. No.: 10/082,292

(22) Filed: Feb. 26, 2002

(65) Prior Publication Data

US 2003/0160052 A1 Aug. 28, 2003

(51) Int. Cl.[7] ..... A47F 5/08
(52) U.S. Cl. ..... 312/245; 108/61; 312/351
(58) Field of Search ..... 108/60, 61; 312/351, 312/245, 234.4, 280, 196

(56) References Cited

U.S. PATENT DOCUMENTS

| | | | | | |
|---|---|---|---|---|---|
| 1,592,497 | A | * | 7/1926 | Mays | 312/279 |
| 2,132,652 | A | * | 10/1938 | Schmiedemann | 312/234.4 |
| D151,590 | S | * | 11/1948 | Buckner | D6/426 |
| 3,012,348 | A | * | 12/1961 | Smith | 40/124.2 |
| 3,099,389 | A | | 7/1963 | Vadnai | |
| 3,817,588 | A | * | 6/1974 | Helmers | 312/209 |
| 4,334,359 | A | * | 6/1982 | Kump | 312/111 |
| 4,429,932 | A | * | 2/1984 | Brennan | 312/259 |
| 4,448,307 | A | * | 5/1984 | Roggenkamp | 206/369 |
| 4,807,760 | A | * | 2/1989 | Sussman | 206/581 |
| D325,313 | S | * | 4/1992 | Evenson | D6/553 |
| 5,544,744 | A | * | 8/1996 | Oman | 206/319 |
| 5,564,624 | A | | 10/1996 | Davis, Jr. | |
| D396,163 | S | | 7/1998 | Mutti | |
| 5,836,488 | A | | 11/1998 | Priestley | |
| 6,179,152 | B1 | | 1/2001 | Sarnowski | |
| D453,882 | S | * | 2/2002 | Petri | D6/436 |

OTHER PUBLICATIONS www.azwebtv.com/desk–organizers.html;last update Jun. 1, 2002.*

* cited by examiner

*Primary Examiner*—Janet M. Wilkens
(74) *Attorney, Agent, or Firm*—Siemens Patent Services, LC

(57) ABSTRACT

A table top or wall mountable organizing station for mail or other documents and related items is disclosed. The organizer is centered around an open fronted box having a plurality of adjustable, vertical dividers which typically define 31 slots for organizing documents, such as bill, by due date or other sorting criteria. Drawers below and above the sorting slots, and a tray between the upper drawers, provide storage for unsorted mail, including magazines and similar sized documents, as well as related items, such as scissors, paper clips, postage, and the like. An ancillary sorting and storage tray which may be placed atop the upper drawers provide vertical sorting/storage slots for additional mail/documents, and open topped storage boxes allow additional storage for small related items.

14 Claims, 5 Drawing Sheets

MAIL AND RELATED DOCUMENTS/ITEMS ORGANIZER

BACKGROUND OF THE INVENTION

1. Field of the Invention

The present invention relates to units for organizing mail and related documents and items. More particularly, the invention comprises a organizer having a plurality of slots for sorting and storing documents, drawers for storing related items, such as scissors, tape, pens and pencils, note pads and the like, an optional tray to store unsorted mail, documents, magazines, and the like, and an optional removable shelf containing additional, open topped slots for storing additional documents and related items. Additionally, the invention is, optionally, wall mounted in lieu of table top.

2. Description of the Prior Art

Devices for sorting and storing of personal mail items and related documents within the home or small office are desirable, and a variety of different devices have been set forth over the years which have partially fulfilled these needs.

U.S. Pat. No. 6,179,152 B1, issued to Paul Douglas Sarnowski on Jan. 30, 2001, presents an ARTICLE ORGANIZER for items such as mail. A shallow receptacle tray has a dividing retainer angularly disposed therein and slidable along a track running the length of the tray's bottom. The angled retainer allows mail to be sorted while maintaining a vertical orientation due to the reduced longitudinal depth of the tray.

Sarnowski provides no sorting slots to maintain sorted mail pieces separate from one another, as does the present invention.

U.S. Pat. No. 5,836,488, issued to Paul Timothy Priestly on Nov. 17, 1998, presents a MAIL CARRYING AND ORGANIZING DEVICE a flexible, two compartment bag adapted for attachment to the inner fore arm by a VELCRO® arm band. (Although the use of trademarks is permissible in patent applications, the proprietary nature of the marks should be respected and every effort made to prevent their use in any manner which might adversely affect their validity as trademarks) Priestly does not provide multiple slots for sorting mail or other documents, nor drawers for storing related items, as does the present invention.

U.S. Pat. No. 5,564,624, issued to Amos Davis, Jr. on Oct. 15, 1996, presents a MULTIPLE RECEPTACLE MAIL ORGANIZING SYSTEM, a cabinet having a plurality of individual closed, preferably lockable, boxes adapted for the placement of standard sized mail pieces for different individuals. Drawers above and below the boxes allow for placement of larger pieces of mail. Davis, Jr. does not provide slotted spaces for sorting mail, as does the present invention.

U.S. Pat. No. 3,099,389, issued to Judith Vadnai on Jul. 30, 1963, presents a TOY POST OFFICE having a plurality of drawers and compartments for a child to store items such as stamps, post cards and the like. A slidably removable panel serves as a writing desk and a cover for the box. Vadnai provides no means for sorting mail and other documents, as does the present invention.

U.S. Design Pat. No. 396,163, issued to Michael A. Mutti on Jul. 21, 1998, presents an IN-WALL MAIL ORGANIZER, a box to be mounted with the front flush with a wall and extending into the wall cavity. Three horizontal and downwardly slanting slots allow separation of mail or other items into three groupings, and a shelf at the lower extreme of the organizer may hold small items. Mutti does not allow for sorting into more than three categories, as does the present invention, nor the storage of related items in enclosed drawers.

None of the above inventions and patents, taken either singly or in combination, is seen to describe the instant invention as claimed.

SUMMARY OF THE INVENTION

The present invention consists of a substantially rectilinear box having an open front and enclosed back, sides, top and bottom. The bottom of the open box contains at least one drawer horizontally wider than vertically high. Above the drawers, the box contains a plurality of removable, vertical partitions (typically, 30) which may be inserted into a plurality of slots to form up typically 31 different slots. Fewer partitions may be placed into selected ones of the typically 30 slots to form a lesser number of slots. The present invention may be either wall mounted or placed on a table or desk, and may optionally have a top mounted tray for holding unsorted mail, magazines and similar sized documents and the drawers within the tray may hold other items such as note paper, post cards, stamps and paper clips. An optional ancillary tray having dividers and/or storage boxes may be placed atop the organizer.

Accordingly, it is a principal object of the invention provide a mail and related items organizer which is compact.

Another object of the invention is to provide a mail and related items organizer which is light weight.

Still another object of the invention is to provide a mail and related items organizer which is economical.

It is another object of the invention to provide a mail and related items organizer which may be either wall mounted or placed on a horizontal surface.

It is a further object of the invention to provide a mail and related items organizer which contains a plurality of slots for sorting mail and related documents by category, date or other criteria.

Still another object of the invention is to provide a mail and related items organizer which has drawers for storage of items such as stamps, paper clips, scissors, note paper, and the like.

An additional object of the invention is to provide a mail and related items organizer which has an optional shelf attachment having additional shelf with storage compartments which can be used for different household and office storage needs.

It is again an object of the invention to provide a mail and related items organizer which has a slot for each day of the month for placement of items applicable to the days of the month.

An additional object of the invention is to provide a mail and related items organizer which has a storage area for magazines and similar sized documents.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
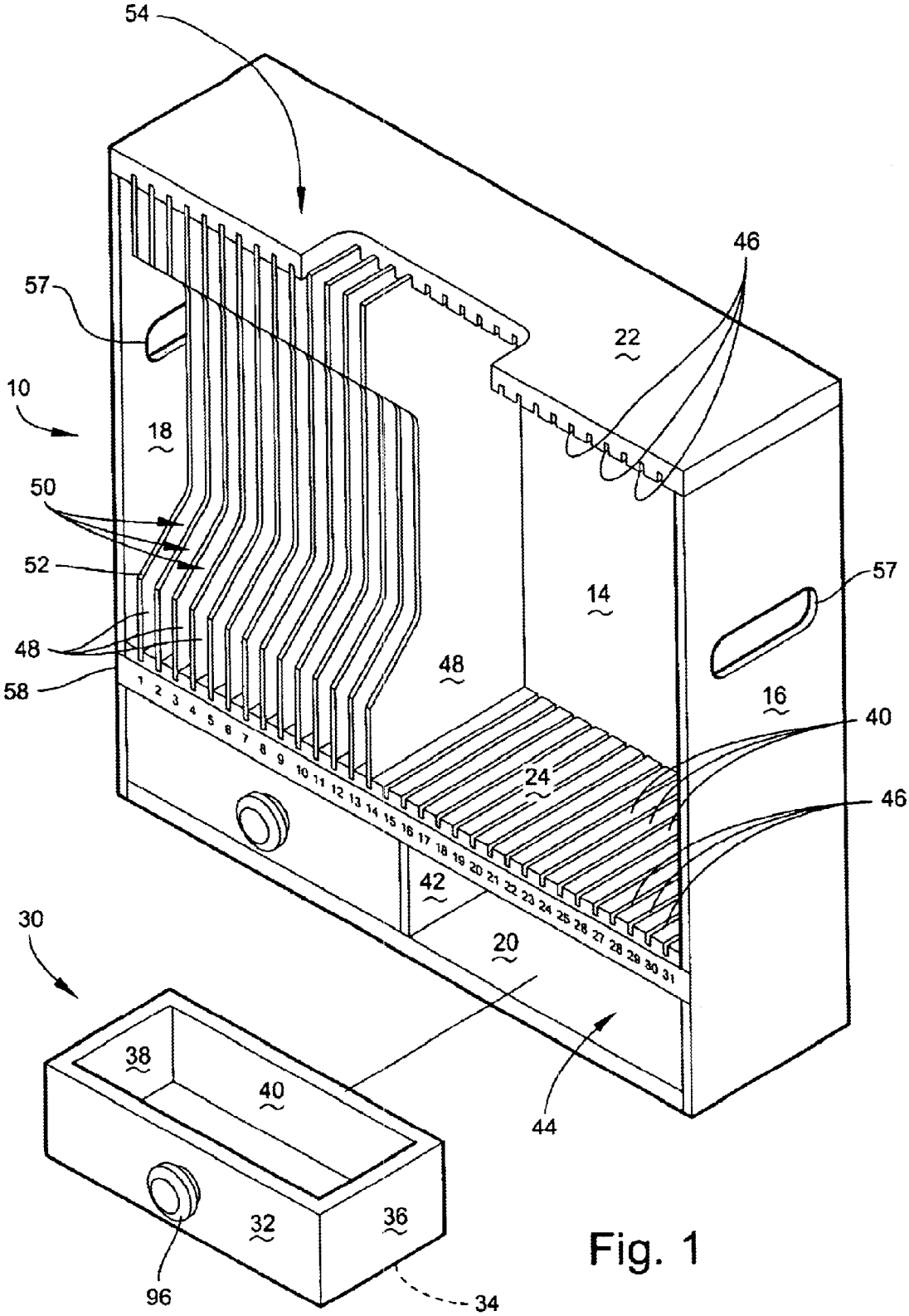
FIG. 1 is a partially exploded front perspective view of the inventive mail and related items organizer in a table top embodiment.
Figure 2:
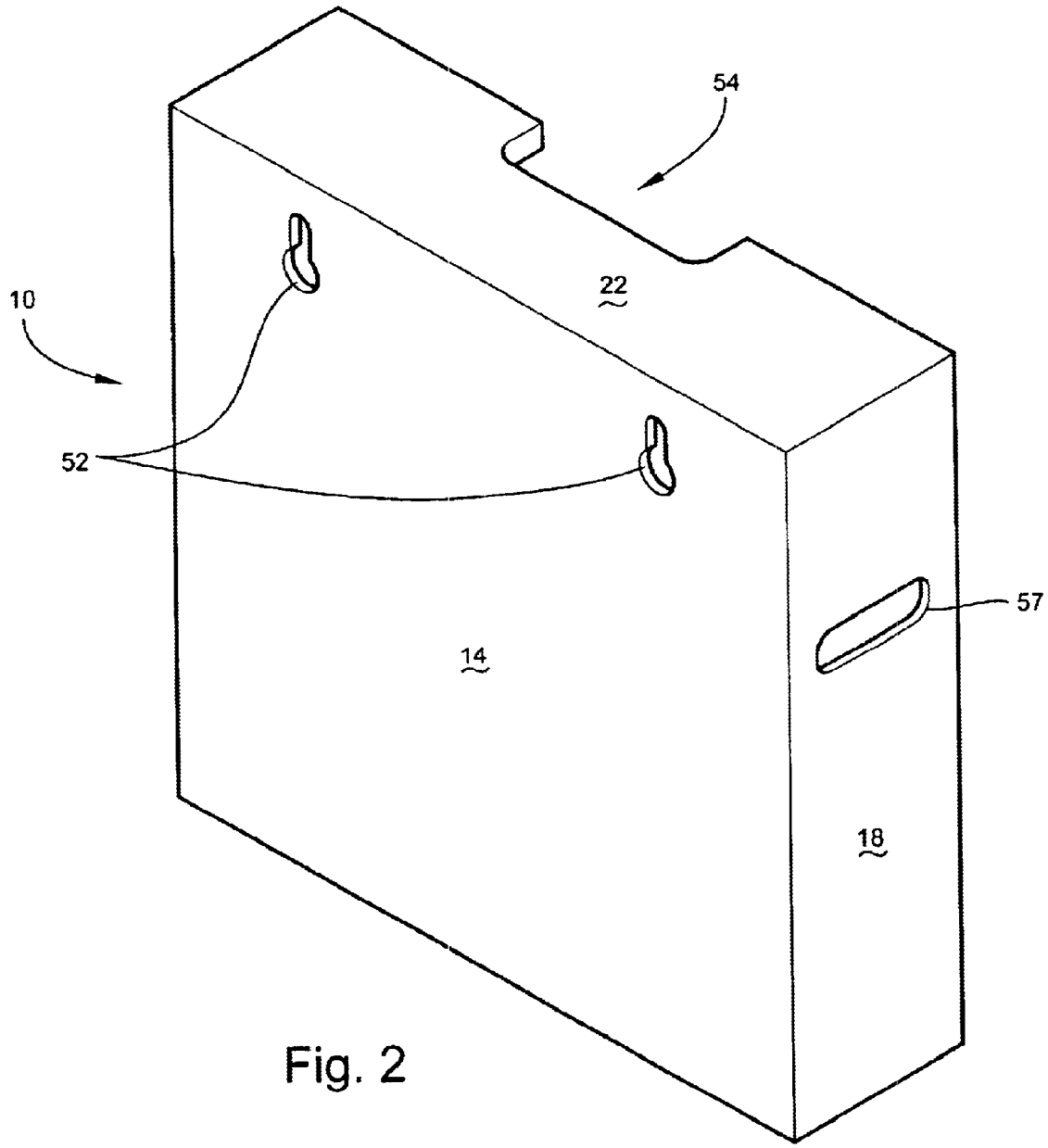
FIG. 2 is a rear perspective view of the inventive mail and related items organizer of the table top embodiment of FIG. 1.

Referring first to FIGS. 1 and 2, organizer 1 consists of a generally rectilinear box 10 having an open front, a back 14, a right 16 and a left side 18, a bottom 20, and a top 22. Proximate bottom 20, at the interior of box 10 is a floor 24 parallel to and spaced apart from bottom 20 by a distance sufficient to allow at least one drawer 30 having a front 32, a bottom 34, a right side 36, a left side 38 and a back 40. A divider 42 normal to and connected to each of the upper surface of bottom 20, lower surface of floor 24 and interior surface of back 14 may separate drawer compartments 44 in an embodiment having a plurality of drawers 30. It would be evident to one skilled in the art that drawer compartments 44 could be formed integral to or as a separate piece from box 10.

A plurality of corresponding grooves 46 (typically, but not necessarily, 30) are formed in the upper surface of floor 24 and the lower surface of top 22, grooves 46 running from front to rear of box 10. A plurality of dividers 48 are supplied with organizer 1, one divider slidably insertable into any or all of the corresponding grooves 46, thereby forming a plurality of slots 50 (typically 31, corresponding to the days of a month). It would be evident to one skilled in the art that corresponding grooves (not shown) could be formed in the interior surface of back 14 between the upper and lower grooves 46, thereby retaining the rear portion of dividers 48. Each divider 48 is substantially rectangular in shape, dimensioned to fit between top 22, floor 24, back 14 and the open front of box 10, and of a width substantially equal to the width of grooves 46. A notch 52 is formed in the central portion of the forward facing edge of dividers 48 providing easily gripable access to items placed in each slot 50 formed between each adjacent pair of dividers 48. A removable upper and lower divider 48 retainer (not shown) may be used to firmly retain dividers 48 in place, or the front edge of grooves may be recessed into bottom 20 and top 22.

A notch 54 may be formed in the central portion of the forward edge of top 22 providing easy access to the slots 50 of organizer 1 from above. The notches 52 of the dividers 48 intended for insertion into the grooves 46 adjacent notch 54 may be extended to the upper end of dividers 48 such that the upper end of dividers 48 do not extend forward of the rear of notch 54. It would be evident to one skilled in the art that the notches 52 of dividers 48 adjacent notch 54 could extend straight from their rearmost point or from a point between their rearmost point and the front edge of the dividers 48.

A pair of mounting holes 56 proximate the upper edge of back 14 facilitate wall mounting of the organizer 1. A hand grip 57 may optionally be disposed in each of left side 16 and right side 18 to facilitate carrying organizer 1 from place to place. An optional strip 58 bearing indicia (1 thru 31, indicating the days of the month, or other indicia) may be mounted along the forward edge of floor 24 or top 22 of box 10, the numbers coinciding with the appropriate slots 50.

Figure 3:
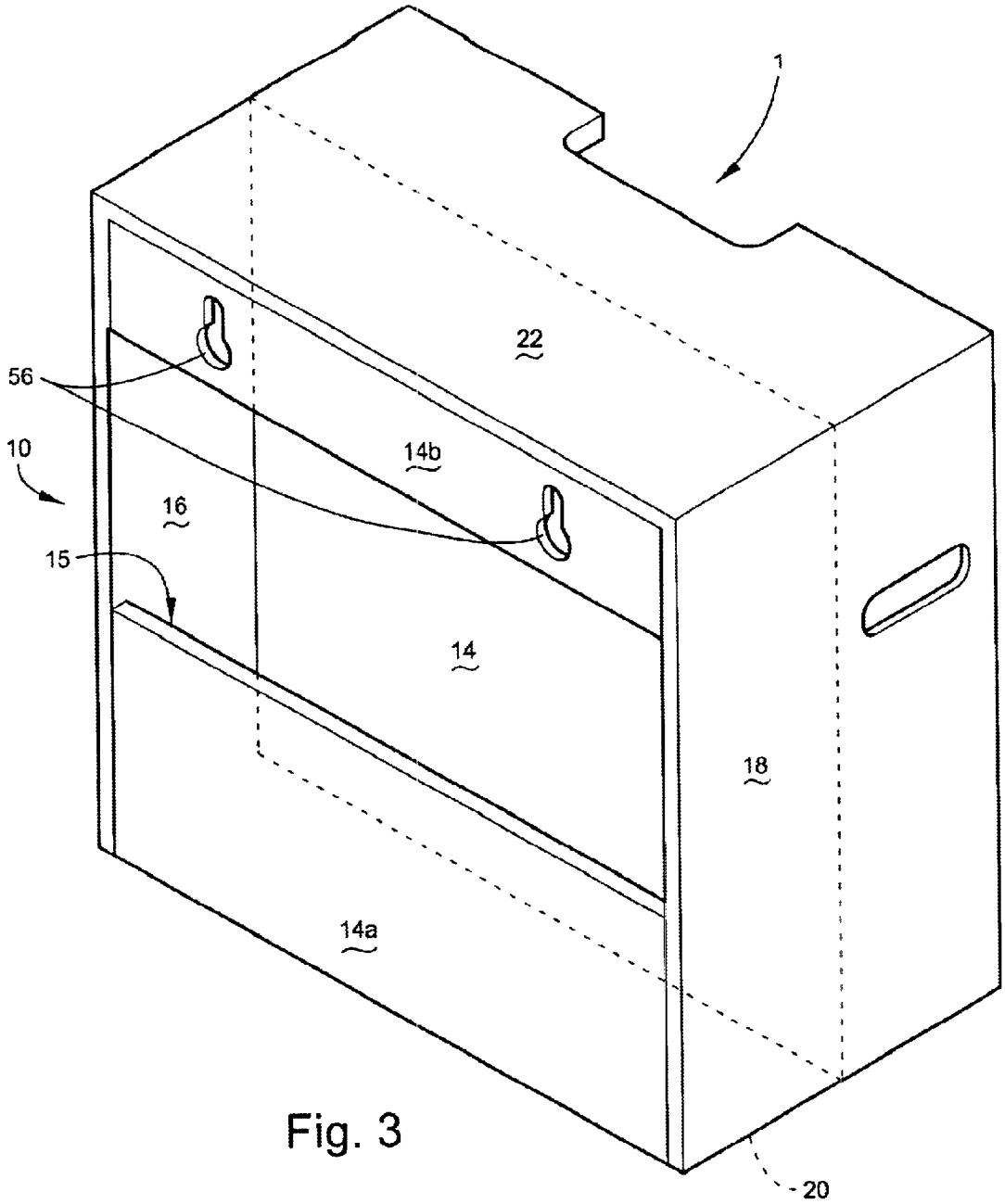
FIG. 3 is a rear perspective view of a second embodiment of the inventive mail and related items organizer of FIG. 1.

FIG. 3 depicts an embodiment of organizer 1 in which bottom 20, top 22, right side 16 and left side 18 extend rearwardly beyond back 14. A rear wall 14*a* rising from and normal to bottom 20 and abutting right side 16 and left side 17 forms a storage well 15, which may be used when organizer 1 is used in a table top embodiment, between back 14, rear wall 14*a*, right side 16 and left side 18. A pair of mounting holes 56 is disposed in an upper rear wall 14*b* to facilitate wall mounting of the organizer. It would be evident to one skilled in the art that an intermediate horizontal shelf (not shown) could be formed in the upper portion of storage well 15, a vertical partition (not shown) may divide storage well 15 into separate compartments, or that the opening between the rear edges of right side 16, left side 18, rear wall 14*a* and upper rear wall 14*b* could be enclosed by door, either hinged or sliding, with or without a locking mechanism.

Figure 4:
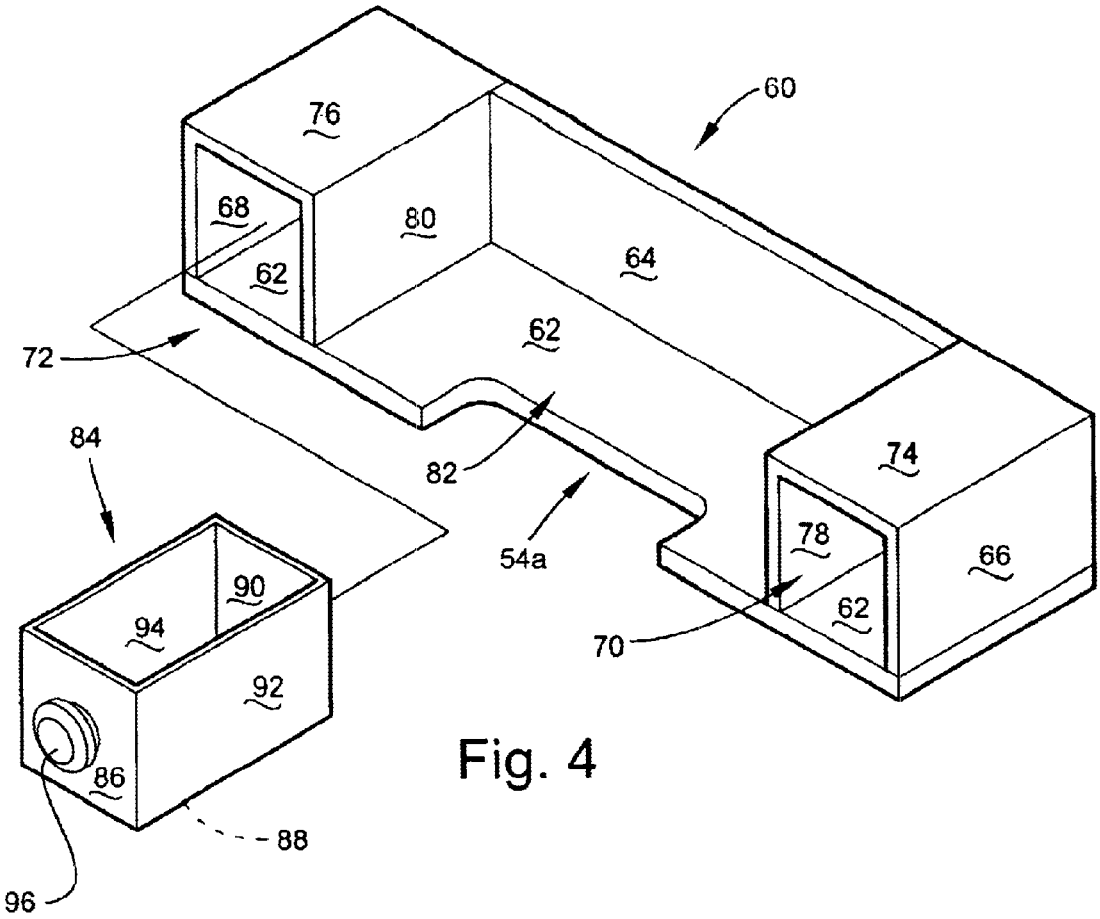
FIG. 4 is a front perspective view of an optional top organizer tray which may be mounted atop the organizer of FIGS. 1 thru 3.
Figure 5:
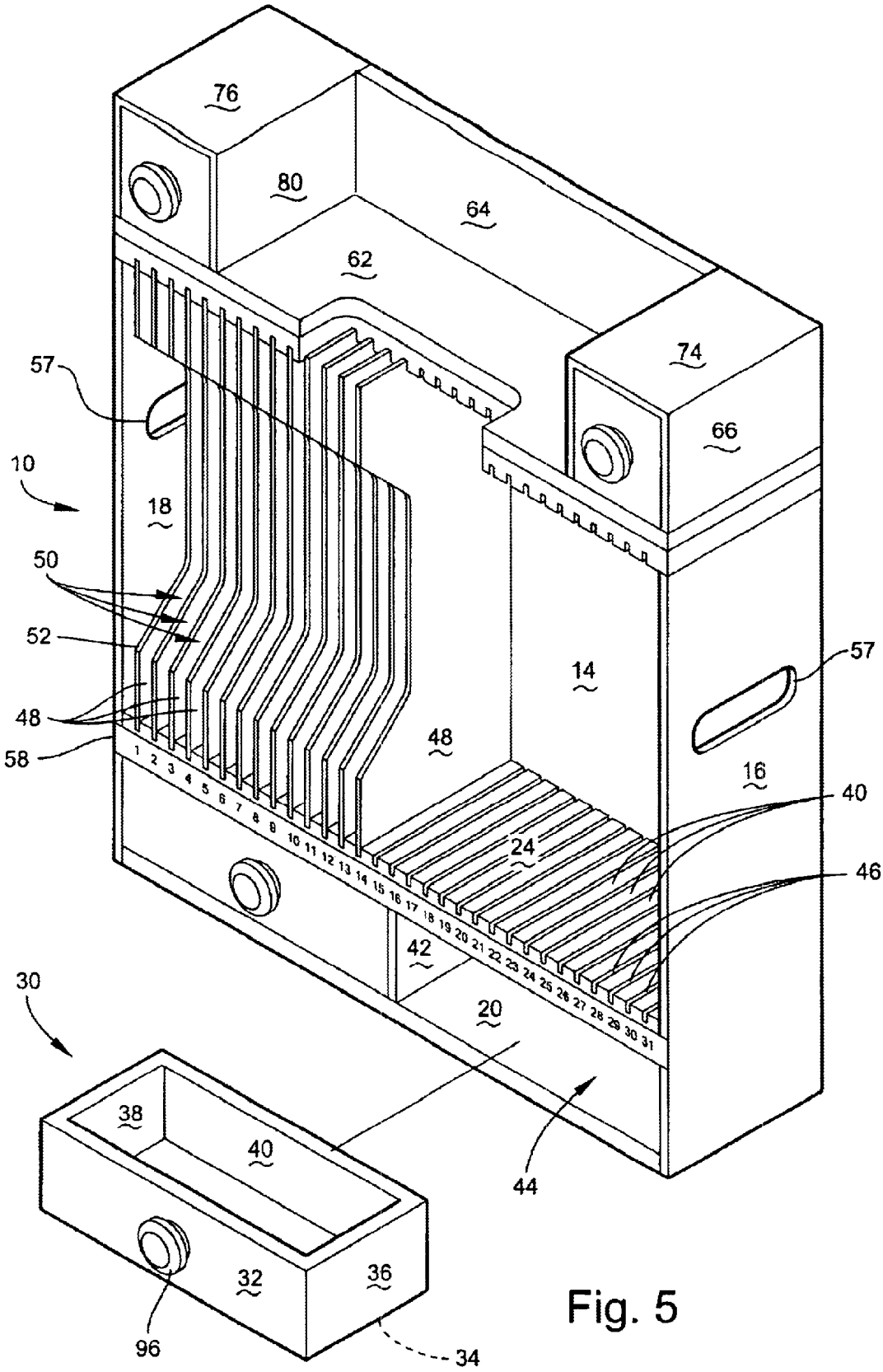
FIG. 5 is an environmental perspective of the organizer of FIGS. 1 thru 3 with the top organizer tray of FIG. 4 incorporated as an integral element.

FIGS. 4 and 5 depict a top organizer 60 which may be situated on the upper surface of top 22, either as an integral part of organizer 1 or as a separate, ancillary unit. As an integral part of organizer 1, the bottom 62 of top organizer 60 and top 22 of box 10 are a single element. For the purposes of disclosure, however, top organizer will be described as a separate unit. Top organizer 60 has a bottom 62 configured to coincide, generally, in size and shape with top 22 of box 1, a back 64, a right side 66 and a left side 68. A notch 54*a* in bottom 62 coincides with notch 54 in top 22 of box 10, providing a convenient means of grasping documents laying on bottom 62 of top organizer 60. Right side 66 and left side 68 each form a right side and a left side, respectively of drawer housings 70 and 72, respectively. Back 64 and bottom 62 form the back and bottom of drawer housings 70 and 72 while drawer housing tops 74 and 76 and drawer housing walls 78 and 80 further enclose drawer housings 70 and 72, respectively. Bottom 62 and back 64 form an organizer tray 82 between drawer housings 70 and 72. A drawer 84 having a front 86, a bottom 88, a back 90, a right side 92 and a left side 94 slidably occupy each of drawer housings 70 and 72. Each drawer 84, as well as each drawer 30 may have a drawer pull 96 mounted on the exterior of drawer fronts 86 and 32.

Figure 6:
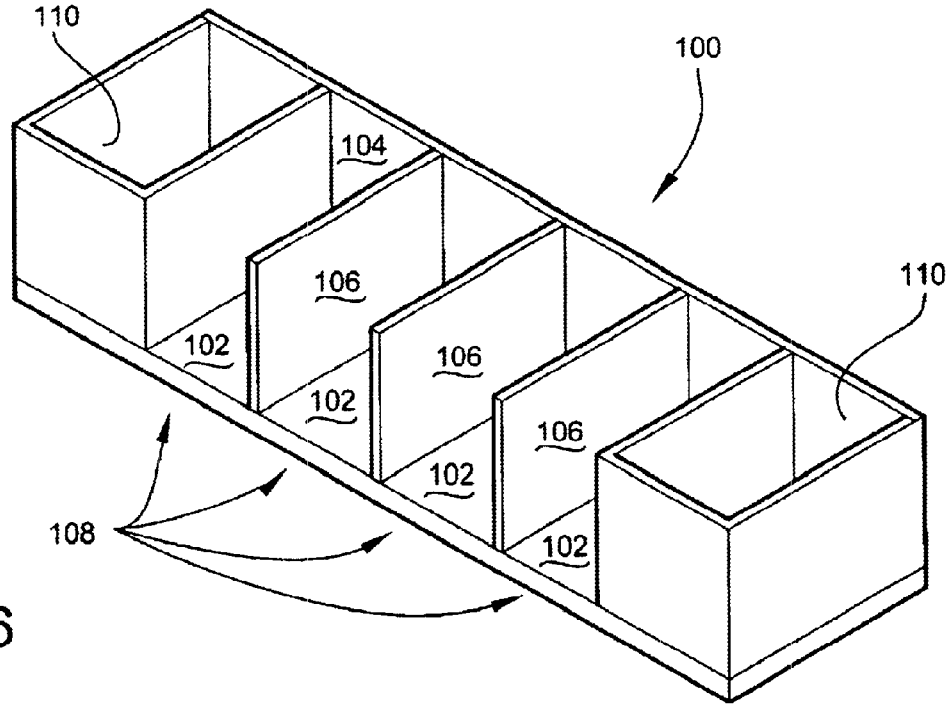
FIG. 6 is a front perspective view of an optional ancillary organizer tray which may be mounted atop the organizer of FIGS. 1 thru 3 or atop the top organizer of FIG. 4.

Now referring to FIG. 6, an optional ancillary sorting or storage tray 100 is presented which may be mounted atop box 10 or atop organizer 60. Ancillary tray 100 has a bottom 102 having a width substantially equal to that of box 10 and a front to back depth less than or equal to than that of box 10, but less than that of top organizer 60, and a back 104 rising from and normal to the rear edge of bottom 102. A plurality of vertical dividers 106 rise normal to bottom 102 and back 104. Dividers 106 may be randomly spaced apart from one another and of random heights, forming a plurality of storage slots 108 for storage of items such as, but certainly not limited to, note pads and post cards and other related items. Open topped boxes 110 may replace selected of dividers 106, especially at the two ends of tray 100. Boxes 110 may be of a single chamber or divided by internal partitions (not shown) into smaller, multiple chambers (not shown). It would be evident to one skilled in the art that an attachment means, known in the art, could be used to firmly attach tray 100 to box 10 or organizer 60.

It would be evident to one skilled in the art that organizer 1 could be mounted, either permanently or removably, on a variety of different base elements, including, but not limited to a swivel base for desk top use, or a wall mounted shelf unit. These base elements are well known in the art and are not deemed to be a part of the present invention.

Organizer 1 is preferably formed of a polymeric material, although it would be evident to one skilled in the art that diverse other materials, as are well know in the art, may be used, including, but not limited to, woods or metals.

It is to be understood that the present invention is not limited to the embodiments described above, but encompasses any and all embodiments within the scope of the following claims.

What is claimed is:

1. A mail and related documents/items organizer comprising:

a substantially rectilinear box having an open, vertical front, a back, a top, a bottom, and a right and a left side; said box further having a horizontal length, a horizontal depth, and a vertical height; and a floor, said floor being substantially parallel to said bottom and said top, spaced apart from said bottom and said top, and abutting and substantially normal to said right and left sides and said back;

said top, said bottom, and said right and left side extend rearwardly beyond said back, creating a concavity therebetween, said box having therein:

sorting means for sorting documents, storage means for storing small items, identification means for identifying elements of said sorting means, and mounting means for mounting said organizer on a wall.

2. A mail and related documents/items organizer, as defined in claim 1, wherein said sorting means comprises:

a plurality of slidably removable, vertical partitions, each of said partitions having a first end removably disposed within one of a plurality of grooves disposed within a lower surface of said top and a second end removably disposed within one of a plurality of grooves disposed within an upper surface of said floor, said grooves engaging said first end and said second end of each of said partitions being substantially parallel to and opposite one another and substantially parallel to said right and left sides of said box, a spaced between said left side one of said partition, each adjacent two of said partitions, and one of said partitions and said right side comprising a slot.

3. A mail and related documents/items organizer, as defined in claim 2, wherein said partitions are fixedly engaged in said grooves.

4. A mail and related documents/items organizer, as defined in claim 1, wherein said storage means comprises:

at least one drawer, said at least one drawer having a front, a back, a bottom, and a right and a left side, and said at least one drawer being slidably disposed between said bottom of said box, said floor of said box and said right and left sides of said box.

5. A mail and related documents/items organizer, as defined in claim 4, wherein:

said at least one drawer comprises a plurality of drawers, and a vertical divider substantially normal to and abutting each of said bottom, said back and said floor of said box separates each of said plurality of drawers from a next of said plurality of said drawers.

6. A mail and related documents/items organizer, as defined in claim 1, wherein said identification means comprises indicia separately and uniquely identifying each of said slots, said indicia being one of the group: applied directly to a surface of said box adjacent said slots, and applied to a strip removably attachable to a surface of said box adjacent said slots.

7. A mail and related documents/items organizer, as defined in claim 1, wherein said mounting means comprises one of the group: mounting holes for receiving a mounting device affixed to a wall, and a mounting device affixed to a rear surface of said back adapted for receiving a mounting device affixed to a wall.

8. A mail and related documents/items organizer, as defined in claim 1, further comprising a top organizer, said top organizer comprising:

a bottom, said bottom having dimensions and shape substantially equal to those of said top of said box, a back, and a right and a left end, said top organizer having:

closed storage means for storing small items, and open surface storage means for storing items.

9. A mail and related documents/items organizer, as defined in claim 8, wherein:

said closed storage means comprises at least one drawer, each of said at least one drawer having a front, a back, a bottom, and a right and left side, and each of said at least one drawer slidably disposed within a drawer housing, said drawer housing further comprising:

a top; a bottom, said bottom being said bottom of said top organizer; a back, said back being said back of said top organizer; and a right and a left side, one of said right and said left side of each of said drawer housing being said one of said right and said left side of said top organizer; and said open surface storage means comprises an upper surface of said bottom of said top organizer not occupied by said at least one drawer housing for said at least one drawer.

10. A mail and related documents/items organizer, as defined in claim 9, wherein:

said at least one drawer comprises two drawers, a first of said two drawers and said drawer housing adjacent said right side of said top organizer and a second of said two drawers and said drawer housing adjacent said left side of said top organizer, and said open surface storage means comprises an upper surface of said bottom of said top organizer between said drawer housings.

11. A mail and related documents/items organizer, as defined in claim 8, wherein said top organizer comprises one of the group:

an integral part of said organizer, said bottom of said top organizer and said top of said box being a single piece, and a separate element from said box, placable upon the top of said box.

12. A mail and related documents/items organizer, as defined in claim 11, wherein said organizer further comprises an ancillary sorting or storage tray, said sorting or storage tray comprising:

a bottom, said bottom having a horizontal length substantially equal to the said horizontal length of said top of said box and a horizontal depth less than the said horizontal depth of said top of said box; a back, said back being normal to a rear edge of said bottom; a plurality of vertical dividers substantially equal in length to said horizontal depth of said bottom, rising normal to said bottom and said back, said vertical dividers adapted to create slots therebetween, said slots being open at a top and a front end thereof.

13. A mail and related documents/items organizers, as defined in claim 12, wherein at least one of said vertical dividers comprises at least one open topped box, said at least one open topped box adapted to hold small items.

14. A mail and related documents/items organizer, as defined in claim 1, wherein:

said concavity further comprises, a rear wall rising from and normal to a rear edge of said bottom, and abutting a rear edge of said right and left sides, said rear wall having a vertical height less than that of said back, thereby forming a storage well between said back, said right and left sides and said rear wall.

* * * * *